US011766127B1

(12) United States Patent
Xu

(10) Patent No.: US 11,766,127 B1
(45) Date of Patent: Sep. 26, 2023

(54) DETACHABLE SWIVEL TIN CHAIR

(71) Applicant: Anji Hengfeng Bamboo and Wood Products Co., Ltd., Huzhou (CN)

(72) Inventor: Zhenjie Xu, Huzhou (CN)

(73) Assignee: Anji Hengfeng Bamboo and Wood Products Co., Ltd., Huzhou (CN)

( * ) Notice: Subject to any disclaimer, the term of this patent is extended or adjusted under 35 U.S.C. 154(b) by 0 days.

(21) Appl. No.: 17/748,227

(22) Filed: May 19, 2022

(30) Foreign Application Priority Data

Apr. 18, 2022 (CN) ..... 202220897354.0

(51) Int. Cl.

| | |
|---|---|
| ***A47C 3/18*** | (2006.01) |
| ***A47C 7/00*** | (2006.01) |
| ***A47C 7/02*** | (2006.01) |
| *A47C 9/00* | (2006.01) |

(52) U.S. Cl.
CPC ..... *A47C 3/18* (2013.01); *A47C 7/002* (2013.01); *A47C 7/02* (2013.01); *A47C 9/007* (2013.01)

(58) Field of Classification Search
CPC ..... A47C 3/18; A47C 7/002; A47C 7/50
USPC ..... 297/344.21
See application file for complete search history.

(56) References Cited

U.S. PATENT DOCUMENTS

| | | | | |
|---|---|---|---|---|
| 3,009,739 | A * | 11/1961 | Hamilton | A47C 3/18 297/461 |
| D693,136 | S * | 11/2013 | Lee | D6/349 |
| 9,575,704 | B2 * | 2/2017 | Yamada | H04N 1/00307 |
| 9,629,465 | B2 * | 4/2017 | Williams | A47C 3/18 |
| 2008/0001462 | A1 * | 1/2008 | Holland | A47C 7/50 297/440.1 |
| 2014/0028069 | A1 * | 1/2014 | Weiss | A47C 3/18 297/344.21 |

* cited by examiner

*Primary Examiner* — Sarah B McPartlin
(74) *Attorney, Agent, or Firm* — Georgi Korobanov

(57) ABSTRACT

A detachable swivel tin chair comprises a seat, chair leg and tray, the tray comprises an upper connecting tray, a lower connecting tray and a rotating device. The rotating device comprises a first connecting piece, a ball bearing and a second connecting piece. The first and second connecting piece rotate relative to each other through the ball bearing, the seat is fixedly connected to the upper end of the upper connecting tray. The chair legs include four supporting legs, the upper end of the legs are provided with an arc-shaped folded edge, which is provided with three first screw holes, the lower end of the lower connecting tray is provided with second screw holes. A long annular reinforcing rib is welded on the middle and lower sections of the supporting leg and connecting pieces are welded at the middle and lower sections on the inner side of the supporting feet.

6 Claims, 3 Drawing Sheets

DETACHABLE SWIVEL TIN CHAIR

CROSS-REFERENCE TO RELATED APPLICATIONS

This application claims priority to Chinese Patent Application No. 202220897354.0, filed on Apr. 18, 2022, the contents of which are herein incorporated by reference in their entireties.

TECHNICAL FIELD

The present application relates to the field of seating equipment, and in particular, to a detachable swivel tin chair.

BACKGROUND

Due to its low cost and high firmness, tin chairs have become popular in bars, restaurants and other occasions that require a lot of seating. The production capacity of chairs in the applicant's location accounts for more than 60% of the world's total. The inventors are well aware of the shipments of tin chairs and some unsolved problems existing in the existing tin chairs.

Due to the large volume of shipments, the main selling point of the current tin chairs is also cheap. Therefore, businesses are very sensitive to the transportation price of tin chairs, and the freight cost of tin chairs depends on the packing volume of tin chairs. The larger the packing volume of tin chairs, the lower the freight cost of a single iron chair.

For example, the Chinese patent application CN201621416552.1, discloses a tin chair, wherein the seat surface and the chair legs are fixedly riveted by rivets. By, replacing the traditional iron plate with thinner and lighter materials, the problem of rust is more effectively solved. In addition, the thickness of the entire board is reduced by 0.2-0.4 mm, which reduces the cost and increases the transportation volume of the product. In this way, although the transportation volume of the product is increased to a certain extent, the packing volume of the tin chair is still low.

Therefore, many businesses also provide detachable swivel tin chairs to increase the packing volume of the tin chairs, but the detachable swivel tin chairs easily lead to problems in the stability, comfort and service life of the tin chairs.

SUMMARY

In order to solve the above-mentioned technical problems, the purpose of the present application is to provide a detachable swivel tin chair, which is easy to assemble and disassemble, has high comfort and long service life.

In order to achieve the above-mentioned purpose, the utility model adopts the following technical solution:

A detachable swivel tin chair, comprising a seat, chair legs and a tray for connecting the seat and the chair legs, wherein the tray comprises an upper connecting tray, a lower connecting tray and a rotating device, the rotating device sequentially comprises a first connecting piece, a ball bearing and a second connecting piece from top to bottom, and the first connecting piece and the second connecting piece are configured to rotate relative to each other through ball bearings, the lower connecting tray is fixedly connected below the second connecting piece, the upper connecting tray is fixedly connected above the first connecting piece, and the seat is fixedly connected to the upper end face of the upper connecting tray; the chair legs comprise four support legs evenly and fixedly connected to the lower end surface of the lower connecting tray, the upper end of the support leg is provided with an arc-shaped folded edge, and the arc-shaped folded edge is provided with three first screw holes, the three first screw holes are arranged in a triangular shape, and second screw holes corresponding to the first screw holes on the support legs are formed around the lower end surface of the lower connection tray, and by arranging bolts in the first screw holes and the second screw holes, the support legs are fixedly connected to the lower end surface of the lower connection tray; a long ring annular reinforcing rib is welded at the inner and/or outer middle and lower sections of the support leg and a connecting plate for fixing the ring-shaped footrest is welded on the middle and lower sections of the inner side of the support leg, and the connecting plate is provided with a plurality of third screw holes, and the ring-shaped footrest is provided with fourth screw holes corresponding to the third screw holes, and by arranging bolts in the third screw holes and the fourth screw holes, the ring-shaped footrest is fixedly connected to the connecting piece. By dividing the tin chair into a seat, a chair leg, a tray and a ring footrest, and by dividing the chair leg into four legs, the volume of the tin chair during transportation is reduced, and the volume of transportation and packing is increased, By welding long ring-shaped reinforcing ribs on the feet, the pressure bearing capacity and bending resistance of the legs are improved, and the firmness of the tin chair after installation is increased. By arranging an arc-shaped folded edge on the upper end of the support leg, and arranging three first screw holes in a triangle on the arc-shaped folded edge, the firmness of the arc-shaped folded edge is increased, and the tin chair is easy to disassemble and assemble. By arranging the rotating tray, the user's comfort is increased, allowing the user to freely rotate 360°.

Preferably, the detachable swivel tin chair further comprises a seat back, the seat back comprises a backrest piece and a back frame, the back frame is configured to be in a semi-circular arc shape, the two ends of the back frame are respectively fixed on the left and right side walls of the upper connecting tray by bolts, and the upper end of the backrest piece is fixedly arranged in the middle of the back frame, and the lower end of the backrest piece is fixedly arranged on the rear side wall of the upper connecting tray by bolts. The comfort of the tin chair can be increased by arranging a detachable seat back.

Preferably, skirts for shielding the swivel device are provided around the sides of the upper connecting tray, and the surface of the upper connecting tray is provided with a plurality of water flow holes. By arranging skirts around the sides of the upper connecting tray to cover the rotating and increase the aesthetics. By arranging the water flow holes to adapt to the application of outdoor scenes such as rain.

Preferably, the lower connecting tray is formed by surrounding flat tubes, and the lower connecting tray is fixedly provided with a plurality of connections bars, and the second connecting piece is fixedly connected above the connecting bar of the lower connecting tray. The lower connecting tray formed by the surrounding flat tube is more beautiful and firm, and it is convenient to install the rotating device.

Preferably, the ring-shaped footrest is configured to be a square ring-shaped footrest which four corners are all chamfered and the fourth screw holes are arranged on the chamfered corners of the ring-shaped footrest Preferably, the support legs are configured to be sheet metal parts, the lower ends of the support legs are configured to be cylindrical, and a rubber ring is fixed at the lower end of the support leg, By arranging a rubber ring to prevent accidental scratching of the legs, the trim of the chair legs can be facilitated.

The beneficial effects of this application are:

1) By dividing the tin chair into a seat, a chair leg, a tray and a ring footrest, and by dividing the chair leg into four legs, the volume of the tin chair during transportation is reduced, and the volume of transportation and packing is increased;
2) By welding long ring-shaped reinforcing ribs on the feet, the pressure bearing capacity and bending resistance of the legs are improved; by arranging an arc-shaped folded edge on the upper end of the support leg, and arranging three first screw holes in a triangle on the arc-shaped folded edge, the firmness of the arc-shaped folded edge is increased.

Figure 1:
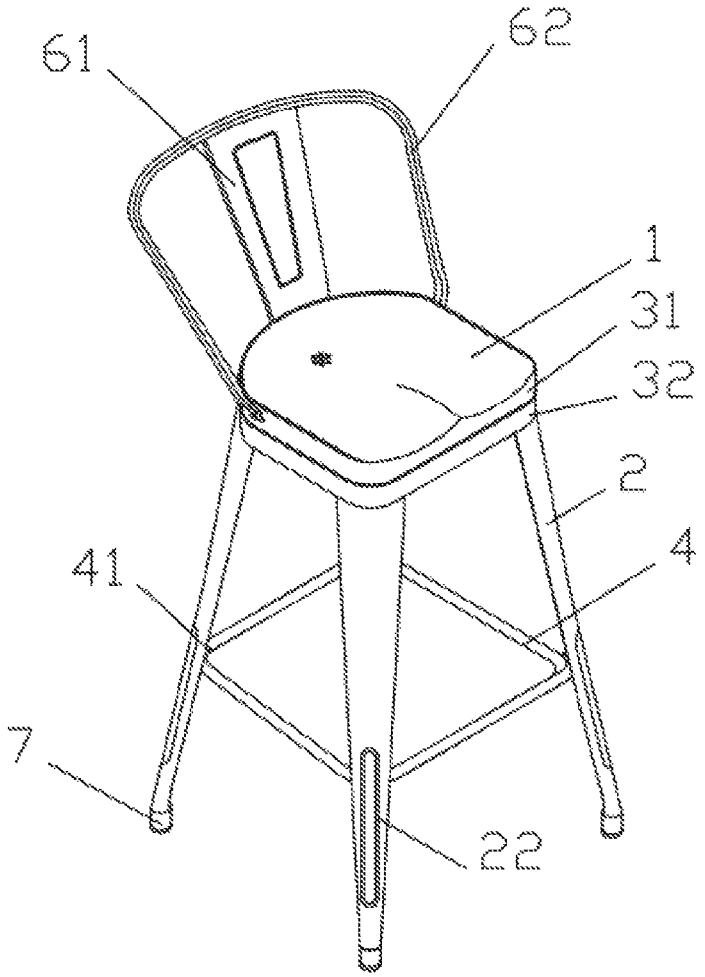
FIG. 1 is a schematic structural diagram of the present application.
Figure 2:
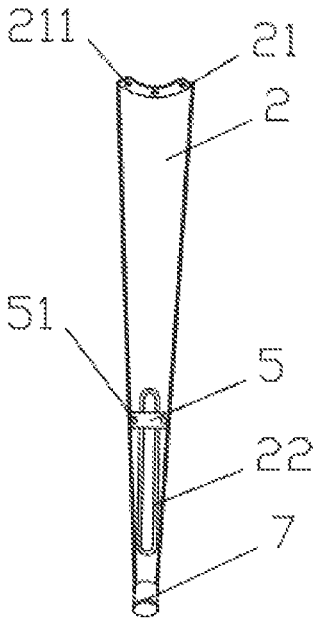
FIG. 2 is a schematic structural diagram of legs.

1. Seat; 2. Leg; 21. Arc-shaped folded edge; 211. First screw hole; 22, Long ring annular reinforcing rib; 3. Tray; 31, Upper connecting tray; 311, Skirt; 32, Lower connecting tray; 321. Connecting bar; 33. Rotating device; 331. First connecting piece; 332. Second connecting pieces; 34. Second screw hole; 4, Ring footrest; 41. Fourth screw hole; 5. Connecting plate; 51. Third screw hole; 61. Backrest piece; 62. Back frame; 7, Rubber ring.

DETAILED DESCRIPTION

The following describes in detail the embodiments of the present application, examples of which are illustrated in the accompanying drawings, wherein the same or similar reference numerals refer to the same or similar elements or elements having the same or similar functions throughout. The embodiments described below with reference to the accompanying drawings are exemplary, and are intended to be used to explain the present application, but should not be construed as a limitation to the present application.

In the description of the present application, it should be noted that the terms "center", "upper", "lower", "left", "right", "vertical", "horizontal", "inner", "outer", etc. which are used to indicate position or positional relationship are based on the position or positional relationship shown in the drawings, and are only for the convenience of describing the application and simplifying the description, rather than indicating or implying that the indicated position or element must have a specific orientation and be constructed in a specific orientation and operation, therefore cannot be understood as a limitation of the present application.

In addition, the terms "first" and "second" are only used for descriptive purposes, and should not be construed as indicating or implying relative importance or implying the number of indicated technical features. Thus, a feature defined as "first" or "second" may expressly or implicitly includes one or more of that feature. In the description of this application, unless stated otherwise, "plurality" means two or more, unless otherwise expressly defined.

In the description of the present application, it should be noted that unless otherwise clearly specified and limited, the terms "installation", "fix" and "connection" should be understood in a broad sense, for example, it can be a fixed connection or a detachable connection, or integrally connected; it can be a mechanical connection or an electrical connection; it can be directly connected, or indirectly connected through an intermediate medium, and it can be the internal communication between two components. For those skilled in the art, the specific meaning of the above-mentioned terms in the present application can be understood according to the specific circumstances.

In this application, unless otherwise expressly specified and defined, a first feature "on" or "under" a second feature may include direct contact between the first and second features, or may include that the first and second features are not in direct contact but through another feature contact. Also, the first feature being "above", "over" and "on" the second feature includes the first feature being directly above and obliquely above the second feature, or simply means that the first feature is level higher than the second feature. The first feature is "below", "under" the second feature includes the first feature being directly below and diagonally below the second feature, or simply means that the first feature has a lower level than the second feature.

For the convenience of expression, in the present application, the position where the user sits is taken as the front, and vice versa.

Embodiment 1

As shown in FIG. 1-4, a detachable swivel tin chair comprises a seat 1, chair legs and a tray 3 for connecting the seat 1 and the chair legs. The chair legs comprise four support legs 2 evenly and fixedly connected to the lower end surface of the tray 3. The upper end of the support leg 2 is provided with an arc-shaped folded edge 21, and the arc-shaped folded edge 21 is provided with three first screw holes 211, the three first screw holes 211 are arranged in a triangular shape, and second screw holes 34 corresponding to the first screw holes 211 on the support legs 2 are formed around the lower end surface of the tray 3, and by arranging bolts in the first screw holes 211 and the second screw holes 34, the support legs 2 are fixedly connected to the lower end surface of the tray 3; a long ring annular reinforcing rib 22 is welded at the inner and/or outer middle and lower sections of the support leg 2, and a connecting plate 5 for taxing the ring-shaped footrest 4 is welded on the middle and lower sections of the inner side of the support leg 2, and the connecting plate 5 is provided with a plurality of third screw holes 51, and the ring-shaped footrest 4 is provided with fourth screw holes 41 corresponding to the third screw holes 51, and by arranging bolts in the third screw holes 51 and the fourth screw holes 41, the ring-shaped footrest 4 is fixedly connected to the connecting plate 5.

By dividing the tin chair into a seat, a chair leg, a tray and a ring footrest, and by dividing the chair leg into four legs, the volume of the tin chair during transportation is reduced, and the volume of transportation and packing is increased. By welding long ring-shaped reinforcing ribs on the feet, the pressure bearing capacity and bending resistance of the legs are improved, and the firmness of the tin chair after installation is increased. By arranging an arc-shaped folded edge on the upper end of the support leg, and arranging three first screw holes in a triangle on the arc-shaped folded edge, the firmness of the arc-shaped folded edge is increased.

The shape of the upper surface of the seat 1 can be a shape that fits the line of the buttocks of the human body, so as to increase the comfort of the user, or can be other plane or curved shapes.

Figure 3:
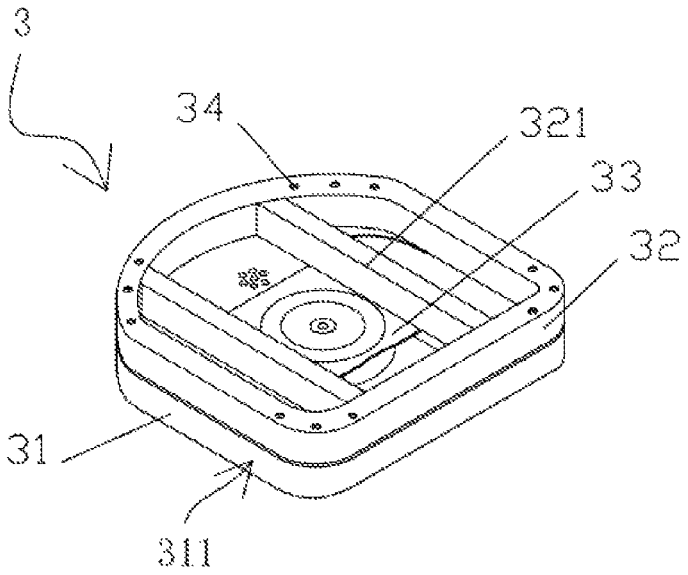
FIG. 3 is a schematic structural diagram of tray.
Figure 4:
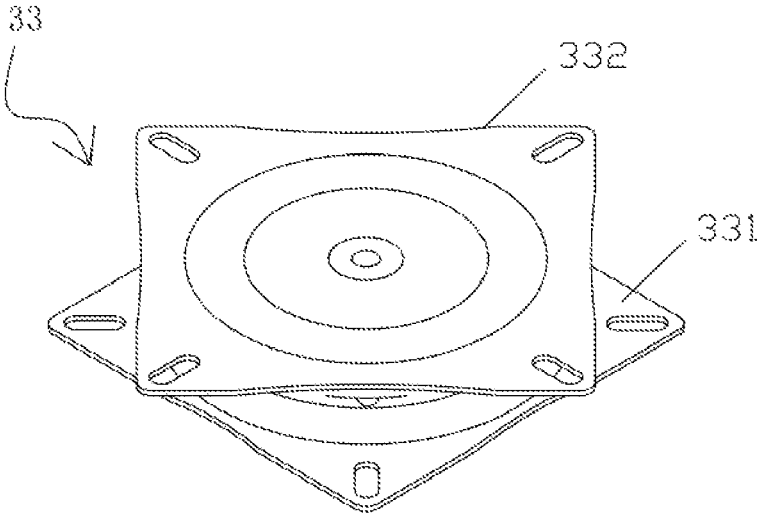
FIG. 4 is a schematic structural diagram of the rotating device.

As shown in FIG. 3, in the present embodiment, the tray 3 comprises an upper connecting tray 31, a lower connecting tray 32 and a rotating device 33, the rotating device 33 sequentially comprises a first connecting piece 331, a ball bearing and a second connecting piece 332 from top to bottom. The ball bearing comprises a fixed ring and a rotating ring that rotates relative to the fixed ring. The first connecting piece 331 and the second connecting piece 332 are respectively fixedly connected with the rotating ring and the fixing ring of the ball bearing, so that the first connecting piece 331 and the second connecting piece 332 are relatively rotated through the ball bearing. By using ball bearings, the seat can be rotated 360° and it is more comfortable to use. The lower connecting tray 32 is fixedly connected below the second connecting piece 332, the upper connecting tray 31 is fixedly connected above the first connecting piece 331, and the seat 1 is fixedly connected to the upper end face of the upper connecting tray 31.

In order to facilitate the user to lean on, the iron chair of the present application also comprises a seat back, the seat back comprises a backrest piece 61 and a back frame 62, the back frame 62 is configured to be in a semi-circular arc shape, the two ends of the back frame 62 are respectively fixed on the left and right side walls of the upper connecting tray 31 by bolts, and the upper end of the backrest piece 61 is fixedly arranged in the middle of the back frame 62, and the lower end of the backrest piece 61 is fixedly arranged on the rear side wall of the upper connecting tray 31 by bolts.

In order to cover the rotating device 33 and make the tin chair look better from the outside, skirts 311 for shielding the rotating device 33 are provided around the sides of the upper connecting tray 31, and the surface of the upper connecting tray 31 is provided with a plurality of water flow holes, so that water is not easy to accumulate on the seat, Which can adapt to outdoor scenes such as rain. The lower connecting tray 32 is formed by surrounding flat tubes, and the lower connecting tray 32 is fixedly provided with a plurality of connections bars 321, and the second connecting piece 332 is fixedly connected above the connecting bar 321 of the lower connecting tray 32. As a result, the weight of the tray can be reduced and the packing volume can be increased.

Preferably, the ring-shaped footrest 4 is configured to be a square ring-shaped footrest which four corners are all chamfered and the fourth screw holes 41 are arranged on the chamfered corners of the ring-shaped footrest 4. Therefore, the contact surface between the ring-shaped footrest 4 and the connecting plate 5 becomes larger, the force-bearing surface is larger, and the firmness is better.

The support legs 2 are configured to be sheet metal parts. The lower ends of the support legs 2 are configured to be cylindrical. This result in a more aesthetically pleasing profile, facilitates trimming of the legs, and prevents accidental scratching of the feet while in use. A rubber ring 7 is fixed at the lower end of the support leg 2.

All the features described in the description, the appended claims and the drawings, alone or in any combination, are essential features of the present application.

In the description of this specification, a description based on the terms "an embodiment", "some embodiments", "an implementation", "specific implementation", "other implementations", "example", "specific example" means that a specific feature, structure, material or characteristic described in connection with the embodiment or example is included in at least one embodiment, implementation or example of the present application, in this specification, schematic representations of the above terms do not necessarily refer to the same embodiment or example. The particular features, structures, materials or characteristics described above may also be combined in any suitable manner in any one or more embodiments, implementations or examples. The technical solutions described in the present application also include technical solutions formed by any one or more of the specific features, structures, materials or features described above in a single or combined manner.

Although the embodiments of the present application have been shown and described above, it should be understood that the above embodiments are exemplary and should not be construed as limiting the present application. Those of ordinary skill in the art can change, modify, replace, verify, delete some features, add features or recombine the features to form new technical solutions within the scope of the present application without departing from the principle and purpose of the present application. The technical solution formed by the combination. Any simple amendments, equivalent changes and modifications made to the above embodiments according to the innovative principles of the present application still fall within the scope of the technical solutions of the present application.

What is claimed is:

1. A detachable swivel tin chair, comprising a seat (1), chair legs and a tray (3) for connecting the seat (1) and the chair legs, wherein the tray (3) comprises an upper connecting tray (31), a lower connecting tray (32) and a rotating device (33), the rotating device (33) sequentially comprises a first connecting piece (331), a ball bearings and a second connecting piece (332) from top to bottom, and the first connecting piece (331) and the second connecting piece (332) are configured to rotate relative to each other through the ball bearings, the lower connecting tray (32) is fixedly connected below the second connecting piece (332), the upper connecting tray (31) is fixedly connected above the first connecting piece (331), and the seat (1) is fixedly connected to an upper end face of the upper connecting tray (31); the chair legs comprise four support legs (2) evenly and fixedly connected to a lower end surface of the lower connecting tray (32), an upper end of the support leg (2) is provided with an arc-shaped folded edge (21), and the arc-shaped folded edge (21) is provided with three first screw holes (211), the three first screw holes (211) are arranged in a triangular shape, and second screw holes (34) corresponding to the first screw holes (211) on the support legs (2) are formed around the lower end surface of the lower connection tray (32), and by arranging bolts in the first screw holes (211) and the second screw holes (34), the support legs (2) are fixedly connected to the lower end surface of the lower connection tray (32); a long ring annular reinforcing rib (22) is welded at an inner and/or outer middle and lower sections of each support leg (2), and a connecting plate (5) for fixing a ring-shaped footrest (4) is welded on the middle and lower sections of an inner side of each of the support legs (2), and the connecting plate (5) is provided with a plurality of third screw holes (51), and the ring-shaped footrest (4) is provided with fourth screw holes (41) corresponding to the third screw holes (51), and by arranging bolts in the third screw holes (51) and the fourth screw holes (41), the ring-shaped footrest (4) is fixedly connected to the connecting plate (5).

2. Detachable swivel tin chair according to claim 1, further comprising a seat back, the seat back comprises a backrest piece (61) and a back frame (62), the back frame (62) is configured to be in a semi-circular arc shape, two ends of the back frame (62) are respectively fixed on left and right side walls of the upper connecting tray (31) by bolts, and an upper end of the backrest piece (61) is fixedly arranged in a middle of the back frame (62), and the lower end of the backrest piece (61) is fixedly arranged on a rear side wall of the upper connecting tray (31) by bolts.

3. Detachable swivel tin chair according to claim 1, wherein skirts (311) for shielding the rotating device (33) are provided around sides of the upper connecting tray (31), and a surface of the upper connecting tray (31) is provided with a plurality of water flow holes.

4. Detachable swivel tin chair according to claim 1, wherein the lower connecting tray (32) is formed by surrounding flat tubes, and the lower connecting tray (32) is fixedly provided with a plurality of connecting bars (321), and the second connecting piece (332) is fixedly connected above the connecting bar (321) of the lower connecting tray (32).

5. Detachable swivel tin chair according to claim 1, wherein the ring-shaped footrest (4) is configured to be a square ring-shaped footrest which four corners are all chamfered and the fourth screw holes (41) are arranged on the chamfered corners of the ring-shaped footrest (4).

6. Detachable swivel tin chair according to claim 1, wherein the support legs (2) are configured to be sheet metal parts, lower ends of the support legs (2) are configured to be cylindrical, and a rubber ring (7) is fixed at the lower end of the support leg (2).

* * * * *